United States Patent [19]

Daly

[11] Patent Number: 4,877,187

[45] **Date of Patent: * Oct. 31, 1989**

[54] UNIT INJECTOR FOR GASOLINE ENGINES

[75] Inventor: Paul D. Daly, Troy, Mich.

[73] Assignee: Allied-Signal Inc., Morris Township, Morris County, N.J.

[ * ] Notice: The portion of the term of this patent subsequent to Nov. 15, 2005 has been disclaimed.

[21] Appl. No.: 215,679

[22] Filed: Jul. 6, 1988

Related U.S. Application Data

[62] Division of Ser. No. 112,653, Oct. 23, 1987, Pat. No. 4,784,322.

[51] Int. Cl.[4] ..... F02M 47/02

[52] U.S. Cl. ..... 239/89; 239/91; 239/93; 239/95; 239/96; 239/327; 239/491; 239/585; 123/447

[58] Field of Search ..... 239/88–96, 239/124, 125, 327, 464, 474, 491, 533.2, 533.12, 533.11, 585; 123/447

[56] References Cited

U.S. PATENT DOCUMENTS

| | | | |
|---|---|---|---|
| 2,630,761 | 3/1953 | Mashinter . | |
| 3,282,512 | 11/1966 | Bluhm et al. | 239/90 |
| 4,222,358 | 9/1980 | Hofbauer | 239/92 |
| 4,544,096 | 10/1985 | Burnett | 239/88 |
| 4,784,322 | 11/1988 | Daly | 239/89 |

*Primary Examiner*—Andres Kashnikow.
*Assistant Examiner*—Christopher G. Trainor
*Attorney, Agent, or Firm*—Russel C. Wells

[57] ABSTRACT

A gasoline unit injector comprising an outer, electrically conductive bellows, defining a variable volume fluid chamber, for reciprocating a piston within a pressure chamber to increase the fuel pressure in various downstream cavities. Various bellows are disposed within such chambers and are deformable in response to the increased pressure, the bellows are operative to control the rate at which fuel flows out from a metering orifice upon activation of a coil assembly.

14 Claims, 3 Drawing Sheets

UNIT INJECTOR FOR GASOLINE ENGINES

This application is a continuation of application Ser. No. 112,653, filed Oct. 23, 1987, now U.S. Pat. No. 4,784,322.

BACKGROUND AND SUMMARY OF INVENTION

The present invention relates generally to fuel injectors for gasoline engines, and more particular to a unit injector for such engines.

A typical gasoline injector for an automotive engine is connected to a fuel rail which is pressurized to a relatively low pressure. Such pressure is typically in the vicinity of 268 kilo-pascals or 39 PSI. It has proved exceedingly difficult to generate a Properly atomized fuel spray pattern at the injector metering orifice due to this low pressure fuel. Further, since known fuel injectors are often attached directly to the engine, the heat of the engine will cause air bubbles to form within various fuel chambers of the fuel injector. Such air bubbles will cause a cycle to cycle variation in the performance of the fuel injector. The formation of these air bubbles is enhanced by this low pressure. It is an object of the present invention to provide a gasoline fuel injector which is communicated to a relatively low source of pressurized fuel and which includes means for increasing such fuel pressure to at least approximately 6895 KPA. It is a further object of the present invention to provide a fuel injector characterized by a finely atomized fuel spray. Another object of the present invention is to provide a fuel injector in which the rate of formation of air bubbles is significantly reduced or eliminated. Accordingly, the present invention comprises:

A unit injector adapted to receive fuel from a relatively low pressure source, comprising:

a housing, armature means responsive to an electromagnetic force for opening and closing a metering orifice to control the ejection of fuel therefrom and various fuel receiving chambers disposed about the armature means and upstream of the metering orifice.

The injector further includes a check valve disposed upstream of the fuel receiving chambers, responsive to a pressure differential thereacros to control the flow of fuel to such chambers and first accumulator means disposed in first of the fuel receiving chambers, compressable in response to the Pressure of the fuel therein for pressurizing the fuel in the various fuel receiving chambers and for controlling the rate at which fuel is ejected.

An outer bellows, received about a portion of the housing, fluidly sealed at one end, and adapted to expand and contract as fuel is received and purged therefrom, including a flexible, springlike wall effective to restore the outer bellows to its non-expanded size.

The injector further includes means defining a pressure chamber, means for communicating fuel to and from the bellows to the pressure chamber, means movable with the outer bellows to pressurize the fuel in the pressure chamber and for urging same across the check valve, to pressurize the fuel in the various fuel receiving chambers, compressing the first accumulator means (180), and means for generating the electromagnetic force to move the armature means away from the metering orifice.

In one embodiment of the invention the moveable means includes a cylindrical shaped piston while in another embodiment of the invention such means includes a cup-shaped piston having an insulative liner.

Many other objects and purposes of the invention will be clear from the following detailed description of the drawings.

DETAILED DESCRIPTION OF THE DRAWINGS

Figures 1, 7:
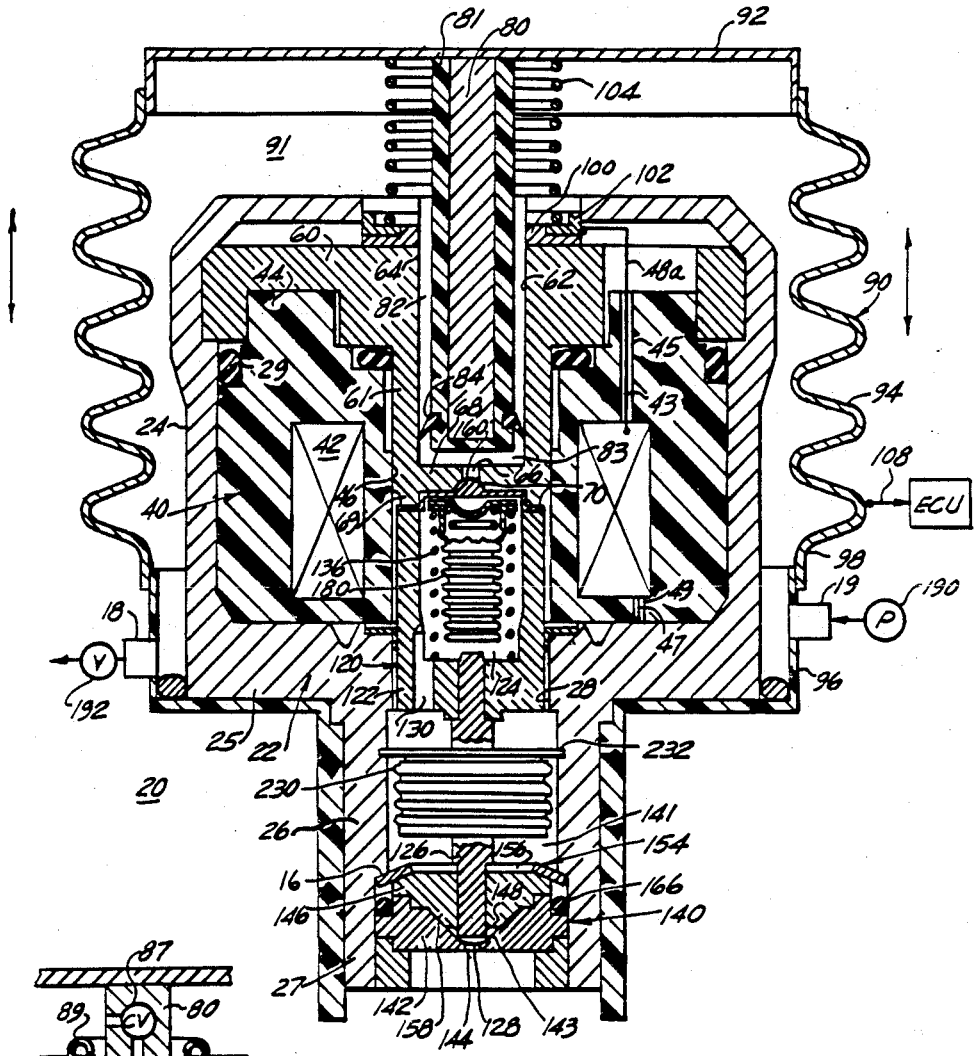
FIG. 1 illustrates a cross-sectional view of a gasoline unit injector constructed in accordance with the present invention.
FIG. 7 illustrates another embodiment of the invention.

FIG. 1 illustrates a gasoline unit injector 20. This injector 20 comprises a housing 22 that includes upper and lower hollow sections 24 and 26. The sections 24 and 26 are joined by a first passage 28 formed in a shoulder portion 25. A coil assembly 40 is positioned within the upper section 24 on the shoulder portion 25. The coil assembly 40 comprises an annular coil 42 magnetically linked with a stator 60. The coil is enclosed by an encapsulate 44 of annular construction and includes a central passage 46 coaxially disposed relative to the first passage 28. A seal such as an 0-ring 29 may be disposed between the encapulant 44 and the housing 22. The coil 42 is of known construction and includes a number of turns sufficient to generate a magnetic force upon excitation. One of the wires 43 forming the coil is communicated through a narrow passage 45 formed in the coil assembly 40. Another end 47 of the wires forming the coil is similarly communicated through a narrow passage 49 also formed in the coil assembly and attached to the housing 22. This wire end 47 forms a grounded connection through the housing to the engine. The precise location and connection of these wires is not important. As an example, the wire 47 can emerge from the top of the injector.

A ferromagnetic stator or piston guide 60 is received through the passage 46 of the coil assembly 40. The piston guide comprises a wall 61 defining a first bore 62 which is open at a top end 64. A narrow first flow passage 66 is formed in a bottom end 68 of the guide. The bottom end 68 is recessed upwardly from the lower end 69 of the wall 61 and further includes a first valve seat 70 formed downstream of the first flow passage 66. A piston 80 is loosly received within the bore 62 of the piston guide 60. The piston 80 is sized to permit fuel to flow through a second flow passage 82 formed between the piston and the piston guide. The lower portion of the second flow passage 82 comprises a Pressure chamber 83 formed between the lower end of the piston 80 and the bottom 68 of the piston guide or stator. The piston 80 further includes sealing means such as a lip seal 84 operative to seal the second flow Passage 82 and chamber 83 when the piston 80 is urged downwardly and oeerative to permit fuel flow through the second flow passage 82 into the chamber 83 when the piston is urged upwardly.

FIG. 7 illustrates an alternate embodiment wherein the lip seal has been replaced by a rolling diaphragm 89 secured to the stator 60 and piston 80'. The piston 80' includes a through passage 85 containing a one-way check valve 87. In operation the diaphragm separates the chambers 91 and 83. Fuel is admitted to the chamber 83 through the check valve 87 as the piston 80' is moved upwardly by the bellows 90 and seals the chamber 83 as the piston is moved downwardly. The diaphragm 89 can alternatively be replaced by an O-ring, secured to the stator 60 through which the piston 80' slides.

The injector 20 further includes means for defining a flexible, resilient fuel receiving chamber 91 in fluid communication with the second flow passage 82. This resilient fuel chamber is positioned about the upper end of the housing 22 and is used for reciprocating the piston 80 within the second flow passage 82. This flexible resilient fuel receiving chamber comprises a first or outer electrically conductive, flexible bellows 90 which includes a top portion 92 operatively engaging the piston 80 and a flexible, springlike wall 94. The bellows 90 further includes a lower section 96 fabricated of an insulative material such as plastic and which surrounds and is sealed to the lower portion of the housing. This insulative section 96 is secured to a lower end 98 of the flexible wall 94 of the bellows 90. The insulative section 96 of the bellows 90 includes means for receiving or venting the fuel from the resilient fuel receiving chamber 91. Such means may include ports 18 and 19. These ports 18 and 19, as the case may be, function as fuel inlets or outlets as more Particularly described below.

The injector further includes means for establishing an electrical connection to the coil 42. Such means includes the grounded wire 47 and the wire 43. In addition, this electrical means further includes a washer 100 fabricated of an insulative material and positioned upon a top portion of the stator or piston guide 60. Positioned above the washer 100 is an electrically conductive member or washer 102 which is urged against the nonconductive washer 100 by a return spring 104. The spring 104 provides a means for electrically connecting the conductive bellows 90 with the conductive washer 102. The end of the wire 43 of coil 42 is connected to the conductive washer 102 thereby completing an electrical circuit from the bellows through to the coil 42. A signal wire 108 is attached by known means to the bellows which permits receipt of control signals generated by an electronic control unit (ECU) of known variety. It should be noted that the spring constant of the return spring 104 is chosen to be relatively weak so as not to affect the reciprocating motion of the piston 80 or bellows 90.

The fuel injector 20 further includes an armature assembly 120. This armature assembly 120 includes an armature 122 slidably positioned within the housing 22 and responsive to a force generated upon excitation of the coil. The armature 122 includes a blind bore or fuel chamber 124 for receiving fuel from the narrow passage 66 formed within the piston guide 60. A narrow pin 126 extends from the armature into a fuel chamber 141 formed in the lower portion of the housing 22. The pin 126 defines a sealing surface 128 at its lower end. The armature 122 includes a plurality of flow passages 130 (only one of such passage is illustrated in FIG. 1) for communicating fuel from the blind bore 124 into the fuel chamber 141. A bias spring 136 is used to urge the armature and pin in a downward direction (as viewed in the drawings).

Figure 4:
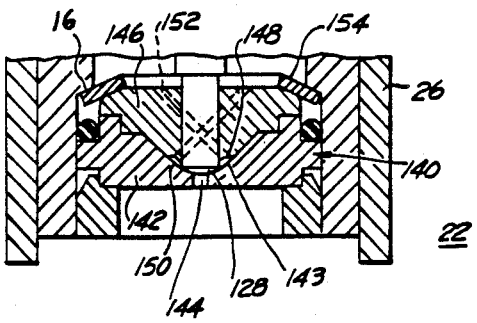
FIG. 4 is an enlargement of the injector shown in FIG. 1.

A valve seat assembly 140 forms, in cooperation with the lower portion of the housing, the chamber 141. The valve seat assembly 140 includes a valve seat 142 defining a seating surface 143, secured within an exit end 27 of the hollow lower housing portion 26 and is adapted to receive the pin 126 to control flow of fuel through a metering orifice 144 which is also formed within the valve seat. A pin guide 146 is postioned upon the valve seat 142 for guiding the pin 126 into engagement with the valve seat. The pin guide includes a cut-out 148 or other similarly contoured surface profile which forms in cooperation with surfaces on the valve seat a swirl chamber 150. A plurality of flow passages 152 (see FIG. 4) are formed within the pin guide 146 for communicating fuel from the lower chamber 141 to the swirl chamber 150. The valve seat assembly may further include a spring member 154 having an opening 156 therein for communicating fuel from the lower chamber 141 to the plurality of passages 152 formed in the pin guide. The spring member 154 is urged against a shoulder 16 formed within the lower housing portion 26 secures the valve seat assembly 140 in place. Appropriate sealing such as an O-ring 166 seals the valve seat assembly 140 relative to the housing 22.

A check valve 160, responsive to a pressure differential thereacross is secured to the piston guide 60 and is operative to control the flow of fuel through the narrow passage 66 in response to such pressure differential. As can be seen from the drawings the check valve permits flow into chamber 124 but does not permit reverse flow.

A first accumulator means for storing pressure such as a closed bellows 180 is disposed within the bore 124 of the armature 122. The bellows 180 may be free floating in the bore 128 or appropriately secured therein by the spring 136.

Figure 2:
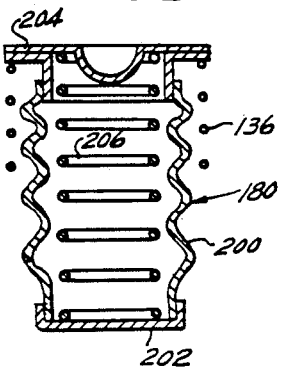
FIG. 2 illustrates a more detailed view of the internal bellows illustrated in FIG. 1.

The operation of the fuel injector shown in FIG. 1 is as follows: Fuel is received from a low pressure fuel pump at port 19. For the purpose of the following discussion, it is assumed that fuel flow from port 18 is either totally blocked by a valve 192 or restricted. In either case, fuel received from the pump will flow into the flexible pressure chamber 91. Various means for Pressurizing the chamber 91 are discussed below. As fuel enters the bellows 90, the bellows will expand thereby urging piston 80 upwardly. This action causes the lip seal 84 to permit flow through passage 82 and into chamber 83. Thereafter the bellows is deflated such as by reversing the direction of a pump 190 or by opening the port 18 permitting fuel within the chamber 91 to be forced therefrom as the bellows 90 collapses to its nonstressed position under the influence of the internal spring action of its walls 94. As the bellows 90 compresses, the piston 80 is moved downwardly which causes the lip seal 84 to seal off the chamber 83. Upon sealing the chamber 83, the piston 80 compresses the fluid therein urging such fluid through the passage 66 to fill the lower portions of the fuel injector. The above inflation and deflation of the bellows is repeated a number of times until the pressure downstream of the check valve 160 has been elevated to a pressure significantly higher than or equal to that of the pressure produced by the pump 190. More Particularly, as the bellows 90 returns to its nominal Position under the influence of its springlike walls 94, a force amplification is created. This amplified force acts upon the fuel within the chamber 83 by virtue of the comparatively smaller piston diameter. After a number of inflation and deflation cycles of the bellows 90, the fuel within the lower portions of the injector 20 will be raised to a pressure level sufficient to urge the check valve 160 against the valve seat 70 thereby preventing a further buildup of fuel within the lower cavities and passages of the fuel injector. At this point, it should be appreciated that subsequent inflation and deflation cycles of the bellows 90 will not further increase the pressure of the fluid within the lower portion of the fuel injector. As the fuel within the bore 124 is pressurized by the motion of the bellows and piston, the accumulator formed by the closed bellows 180 will become compressed due to the highly pressurized fuel acting upon its various surfaces (a more detailed description of the bellows 180 is illustrated in FIG. 2). The fuel injector 20 will remain in the above highly pressurized state until receipt of a control signal on line 108 from an electronic control unit. Such signal is communicated to the coil through the return spring 104, washer 102, and wire 43 thereby generating an electromagnetic force sufficient to urge the armature 122 and pin 126 upwardly from the valve seat 142 to permit the highly pressurize fuel to flow from the fuel chamber 141 into the swirl chamber 150 and out through the metering orifice 144. More specifically, as the metering orifice 144 is opened, the pressurized fuel upstream thereof is rapidly urged therefrom as the bellows 180 expands towards its unstressed length. The rate at which fuel is ejected is, in part, controlled by spring constant of the bellows 180. Upon ejection from the metering orifice 144 a finely atomized spray pattern is formed. Under normal operating conditions the amount of fuel which exits the metering orifice 144 during each activation of the fuel injector 20 is only a small portion of the fuel stored downstream of the check valve 160. Consequently, upon deactivation of the coil assembly such downstream fuel can once again be brought up to the elevated pressure level by relatively few inflation/deflation cycles of the bellows 90. Upon activation of the coil assembly 40, the fuel pressure downstream of the check valve 160 will be reduced below that of the pressure which can be produced by the piston 80. Consequently, during subsequent inflation/deflation cycls of the bellows 90, additional fuel is caused to flow into the fuel injector thereby replacing the small quantity of fuel previously ejected therefrom.

The piston 80 of FIG. 1 is preferrably fabricated of a non-magnetic material (plastic). However, the piston 80 may also include a magnetic core or insert 81. This core or insert 81 is located within the magnetic flux path and upon activation of the coil 42 will be rapidly urged downward. This rapid downward action supplements the pumping action created by the bellows.

FIG. 2 illustrates a more detailed view of the bellows 180 described above. The bellows 180 comprises flexible wall 200 which extends from a closed end 202. The open end of the wall 200 is enclosed by a sealing cap 204. A coil spring 206 is fitted between the closed end 202 and the sealing cap 204 which tends to urge the bellows 180 outwardly to its noncompressed position. It should be noted that the free length of the coil spring 206 is preferrably equal to the free length of the bellows. In addition, the spring rate of the spring 206 is chosen so that nominal pressure (6895 KPA) will produce a 15–75% change in volume.

Figure 3A:
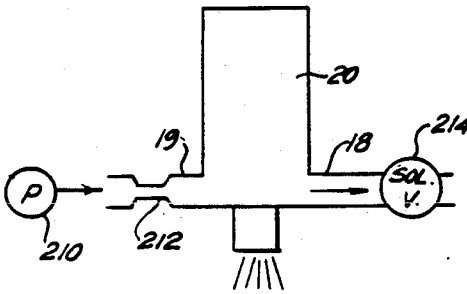
FIGS. 3*a–d* illustrate various mechanisms to control the inflation/deflation cycle of the bellows illustrated in FIG. 1.
Figure 3B:
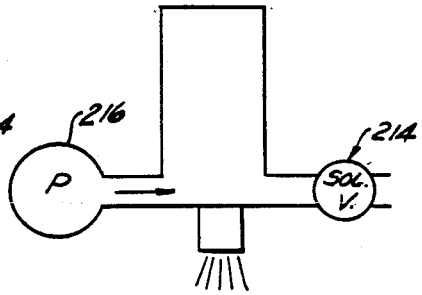
Figure 3C:
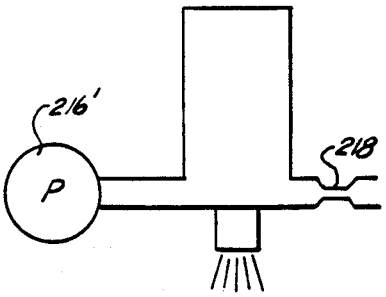
Figure 3D:
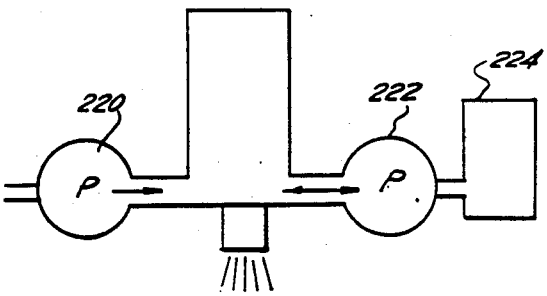

FIGS. 3*a–d* illustrate various mechanisms to control the inflation/deflation cycles of the bellows 90. The configuration illustrated in FIG. 3*a* is best suited for operation in conjunction with a mechanical pump 210. The mechanical pump 210 is communicated through an orifice 212 to the port 19 of the fuel injector 20 (which is schematically represented). The port 18 is communicated to a solenoid 214 which in turn is communicated through various fuel lines to the fuel tank or reservoir (not shown). When the solenoid 214 is closed, low pressure fuel from the pump 210 inflates the bellows 90. The deflation of the bellows 90 is controlled by opening the solenoid 214. It should be noted that the flow through the solenoid 214 should be greater than that through the inlet orifice 212. The opening of solenoid 214 communicates the previously pressurized bellows 90 to a low pressure sump or return to tank thereby allowing the bellows to compress permitting the piston 80 to pressurize the fuel within the chamber 83. FIG. 3*b* illustrates a mechanism similar to that described in FIG. 3*a* and is best suited for an electrical pump 216 installation. In the configuration shown in FIG. 3*b*, inflation of the bellows 90 is achieved by closing the solenoid 214 and energizing the electrical pump 216. Deflation of the bellows 90 is achieved by turning off the pump 216 and opening the solenoid 214. The configuration illustrated in FIG. 3*c* is similar to that disclosed in FIG. 3*b*. However, it does not require the additional solenoid 214. The solenoid 214 is replaced by an exit orifice 218. Since the orifice 218 provides a restricted, though continuous flow path from the bellows 90 to the reservoir, the pumping capacity of the pump 216' illustrated in FIG. 3*c* by necessity must be greater than the pump 216 of FIG. 3*b*. The configuration illustrated in FIG. 3*d* utilizes two pumps 220 and 222. Pump 222 may be of the reversible type and one output of which is communicated to accumulator 224. Both of the pumps 220 and 222 may be of the electrical variety. In order to inflate the bellows 90, both pumps are activated. Pump 220 draws fuel from the reservoir while the pump 222 draws fuel from the accumulator 224. In order to deflate the bellows 90, pump 222 is reversed thereby urging fuel from the pressure chamber 91 to the accumulator 224 while pump 220 is stopped. The configuration therefore in FIG. 3*d* provides for extremely fast actuation and further reduces the amount of fuel flow through the system since no recirculation of the fuel back to the fuel tank or reservoir is required. A further increase in the deflation time or response can be achieved by making both pumps 220 and 222 of the reversible type.

Figure 5:
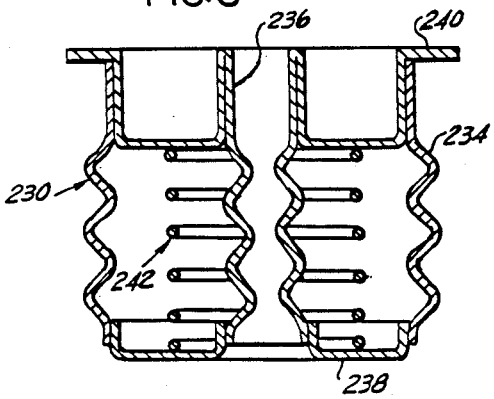
FIG. 5 illustrates a more detailed representation of an alternate bellows shown in FIG. 6.

FIG. 1 further illustrates a further feature of the invention. As mentioned above, the rate at which fuel is pushed out of the injector 20 through the metering orifice depends upon the rate at which the bellows 180 expands. Such rate may be supplemented by including within the pressure chamber 141 a second bellows 230. The bellows 230 is an annular shaped device which surrounds the pin 126 and may be secured at one end 232 thereof to the portion 26 of the housing 22. The bellows 230 is further illustrated in FIG. 5. As can be seen, the bellows comprises internal and external annular, flexible walls 234 and 236. The walls 234 and 236 are secured by end caps 238 and 240. An annular coil spring 242 is fitted within the space between the walls 234 and 236. The end caps 238 and 240 are similarly annularly shaped having openings to permit the pin 126 to extend therethrough.

Figure 6:
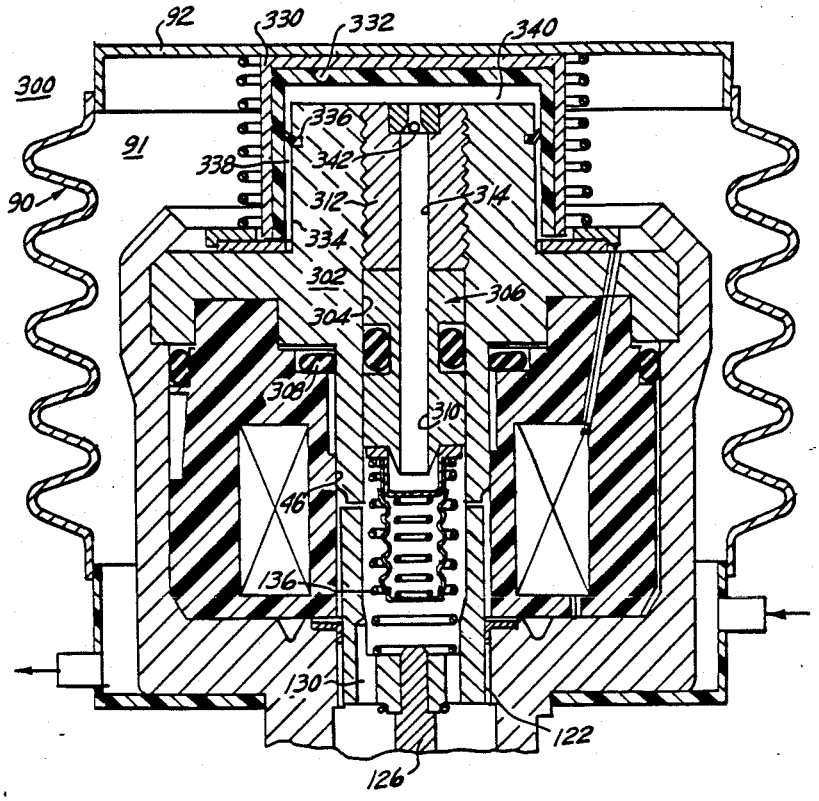
FIG. 6 illustrates an additional embodiment of the invention.

Reference is made to FIG. 6 which illustrates an alternate embodiment of the above-described fuel injector. The injector 300 illustrated in FIG. 6 operates in a substantially identical manner to that of the above-described fuel injector 20 and additionally Permits the calibration of such fuel injector. As will be noted upon comparing FIGS. 1 and 6, the injectors are substantially identical. The injector of FIG. 6 however does not utilize the cylindrically shaped piston 80 of FIG. 1. Inserted within the second passage 46 of the coil assembly 40 is a stator 302. The stator 302 includes a central bore 304 into which is received a piston or plug 306. A seal such as O-ring 308 is positioned between the piston and the stator 302. The piston further includes a passage 310 for communicating fuel to the armature 122. Threadably received within the stator 302 is a threaded member or spacer 312 which also includes a passage 314 in communication with the Passage 310 formed in the piston. Extending downwardly from the piston 306 against the armature is the bias spring 136. The threaded spacer 312 can be advanced or extracted, thereby moving the piston 306 inwardly and outwardly to change the bias force on the armature 122 permitting calibration of the fuel injector 300. Extending inwardly from the top 92 of the bellows 90 is a cup 330 preferably made of steel or other similarly rigid material.

Positioned interior to the cup 330 is a cup-shaped insulative liner 332. Secured to the stator 302 is a lip seal 336 which engages the interior wall of the liner 332. Such wall is spaced from the wall 334 of the stator 302 to form an annular flow passage 338. The bottom center of the liner 332 and top of the stator 302 cooperate to form a pressure chamber 340. Fitted within the threaded member 312 is a check valve 342 (shown schematically) which selectively permits flow from the Pressure chamber 340 to the passage 314 in response to the pressure differential thereacross.

The injector 300 operates similarly to the injector 20. As the bellows 90 is inflated the piston 330 is urged upwardly relative to the stator 302. The upward motion of the piston causes the lip seal 336 to open permitting fuel to flow into the pressure chamber 340 from chamber 91. Upon deflation of the bellows, as described above, the piston moves downwardly causing the lip seal 336 to seal the chamber 340. Subsequent downward motion of the piston 330 compresses the fuel with the chamber urging same through the check valve 342 into the various downstream cavities of the fuel injector. Subsequent inflation/deflation cycles of the bellows 90 will cause additional fuel to be urged into such downstream cavities, compressing the bellows 180 (or bellows 220) with the check valve 342 operative to prevent reverse fluid flow. Due to the differential areas of the piston 330 and bellows 90, the pressure of the fuel downstream of the check valve 342 will be elevated substantially over the exit pressure of the pump supplying fuel to the bellows 90. The process of ejecting fuel from the injector 300 is identical to that for injector 20. Replenishment of fuel to the injector and repressurization of the fuel is accomplished by subsequently inflating and deflating the bellows 90.

Many changes and modifications in the above described embodiment of the invention can, of course, be carried out without departing from the scope thereof. Accordingly, that scope is intended to be limited only by the scope of the appended claims.

I claim:

1. A unit injector adapted to receive fuel from a relatively low pressure source, comprising:

a housing;

armature means responsive to an electromagnetic force for opening and closing a metering orifice to control the ejection of fuel therefrom;

a fuel receiving chamber disposed upstream of the metering orifice;

a check valve disposed upstream of the fuel receiving chamber, responsive to a pressure differential thereacross to control the flow of fuel to such chamber;

first accumulator means disposed in the fuel receiving chamber, compressible in response to the pressure of the fuel therein for pressurizing fuel upstream of the metering orifice;

an outer bellows, fluidly sealed at one end, and adapted to expand and contract as fuel is received and purged therefrom, including a flexible, spring-like wall effecting to restore the outer bellows to its non-expanded size;

means defining a pressure chamber;

means movable with the outer bellows to pressurize the fuel in the pressure chamber and for urging same across the check valve, compressing the first accumulator means; and means for generating the electromagnetic force to move the armature means away from the metering orifice.

2. The injector as defined in claim 1 wherein the movable means comprises a piston reciprocatively moved by the outer bellows within a first passage, including first means operative for permitting fuel into the pressure chamber when the piston is moving upwardly and for sealing the pressure chamber when the piston is moved downwardly.

3. The injector as defined in claim 2 wherein the first means for permitting fuel into the passage chamber comprises a seal circumferentially disposed between the piston and the interior of the first passage.

4. The injector as defined in claim 3 wherein the seal comprises a lip seal circumferentially disposed about the piston.

5. The injector as defined in claim 2 wherein the piston is nonconductive.

6. The injector as defined in claim 5 wherein the piston includes a ferromagnetic insert.

7. The injector as defined in claim 1 wherein the means for generating the electromagnetic force comprises a stator and a coil magnetically coupled thereto, the stator comprising a first bore adapted to loosely receive the piston, space therebetween defining the first passage, the bottom of the first bore and piston cooperating to define the pressure chamber, and a narrow passage extending through the stator for communicating fluid from the pressure chamber to the first fuel receiving chamber across the check valve.

8. The injector as defined in claim 1 wherein amature means includes an armature disposed downstream of the check valve including a second bore formed within the armature defining the fuel receiving chamber, and a first spring received within the second bore for urging the armature to close the metering orifice.

9. The injector as defined in claim 8 wherein a pin extends from the armature to engage a valve seating surface of a valve seat, the valve seating surface disposed immediately upstream of the metering orifice.

10. The injector as defined in claim 8 including a second fuel receiving chamber which is disposed downstream of the armature, such chamber surrounding the pin, the armature further including passages for communicating fuel from the second bore to the second fuel receiving chamber, a toroidal bellows means disposed in the second fuel receiving chamber, for pressurizing the fuel therein to a predetermined value during instances where the metering orifice is closed and for causing the fuel to flow out of the metering orifice at a predetermined rate as it expands during instances when the metering orifice is open.

11. The injector as defined in claim 10 wherein a pin guide is positioned upon the valve seat, the pin guide including a lower contoured surface for forming in cooperation with the valve seat a swirl chamber immediately upstream of the metering orifice, and obliquely oriented passages for communicating fuel from the second fuel receiving chamber into the swirl chamber, the swirl chamber operative to rotationally accelerate the fuel prior to ejection from the metering orifice.

12. The fuel injector as defined in claim 11 wherein the outer bellows is electrically conductive and wherein the injector further includes an insulator disposed upon the stator, a conductive spring in electrical contact with the outer bellows, a conductive spring retainer disposed between an end of the conductive spring, and the insulator, wherein an end of the wire forming the coil is connected to the spring retainer.

13. The injector as defined in claim 12 wherein another end of the coil wire is connected to the housing.

14. The injector as defined in claim 1 including second means for inflating and deflating the outer bellows.

* * * * *